United States Patent [19]

Bondarenko et al.

[11] 4,196,551

[45] Apr. 8, 1980

[54] SECTIONAL TOWER STRUCTURE

[76] Inventors: Vladimir B. Bondarenko, ulitsa Brolosanskaya 31, kv. 1; Archil S. Kubaneishvili, ulitsa Budapeshtskaya, 6, kv. 51; Fedor G. Meladze, ulitsa Bakhtrioni korpus 2, kv. 45, all of Tbilisi; Fedor V. Sapozhnikov, ulitsa Nikolaeva, 4, kv. 12, Moscow, all of U.S.S.R.

[21] Appl. No.: 946,035

[22] Filed: Sep. 26, 1978

[30] Foreign Application Priority Data

Mar. 21, 1978 [SU] U.S.S.R. ..... 2588251

[51] Int. Cl.[2] ..... E04C 3/10

[52] U.S. Cl. ..... 52/227; 52/245

[58] Field of Search ..... 52/223 R, 227, 648, 52/244, 247, 245

[56] References Cited

U.S. PATENT DOCUMENTS

| | | | |
|---|---|---|---|
| 3,618,277 | 11/1971 | Waters | 52/245 X |
| 3,922,827 | 12/1975 | Rosenblatt | 52/245 |
| 4,092,811 | 6/1978 | Lin et al. | 52/80 X |

FOREIGN PATENT DOCUMENTS

| | | | |
|---|---|---|---|
| 183935 | 11/1955 | Austria | 52/227 |
| 479863 | 11/1975 | U.S.S.R. | 52/245 |

*Primary Examiner*—Carl D. Friedman

*Attorney, Agent, or Firm*—Fleit & Jacobson

[57] ABSTRACT

The present invention relates to sectional tower structures for most effective use as supporting structures of tall smoke stacks exceeding 250 m in height. Said structure comprises a reinforced-concrete lattice framework made in the form of an one-sheet hyperboloid and constituted by intersecting inclined straight uprights consisting of individual elements. These elements are provided longitudinally with prestressed reinforcement strands anchored in the bands located at the points of maximum convergence of the adjacent uprights. The number of said uprights diminishes from tier to tier and the uprights constituting each corresponding tier except the 1st one, are a straight extension of a part of the uprights of the underlying tiers.

5 Claims, 5 Drawing Figures

SECTIONAL TOWER STRUCTURE

The present invention relates to erection of radio, T.V. and water towers, cooling towers, also of smoke stacks for atomic and thermal power stations.

The sectional tower structure according to the present invention will be used quite effectively as a supporting structure for very tall smoke stacks (higher than 250 m).

The ever-growing power of the thermal power stations and widespread construction of atomic power stations brings to light the problem of preserving the ambient atmosphere against pollution with smoke gases and other production waste. This calls for increasing the height of the smoke stacks, provided adequate measures are taken to raise their reliability by introducing new engineering solutions, cutting down the time spent for erection and industrial fabrication of the elements comprised in the tower.

At present, both in the USSR and abroad the most common practice is to use reinforced concrete and steel smoke stacks.

When selecting the design of a tall smoke stack, the crucial factor is its reliability during long-term operation. Experience has proved that at elevated temperatures and under the detrimental effect of gases the reinforced-concrete stacks are more durable than the metallic ones. Besides, the steel stacks call for the use of a large amount of costly metal and are uneconomical in operation. Therefore, in recent times the power thermal power stations have been built, mainly, with reinforced concrete stacks.

It should be noted that both in our country and abroad it is considered that the most reliable and economical design is the "pipe-in-pipe" construction consisting of an outer supporting reinforced-concrete shell and an inner gas-discharge shaft.

The erection of stacks of this design has been practiced both in the USSR (stacks up to 320 m high) and abroad, e.g. in USA, Federal Republic of Germany, Japan, England, France, German Democratic Republic.

All these stacks have been erected in a monolithic version with the aid of movable or sliding formwork. However, the utilization of such formwork involves the use of sophisticated and expensive equipment and hinders considerably the quality control of concrete and reinforcement work. Moreover, in regions with severe climatic conditions concrete has to be placed into monolithic shafts with the aid of special warmup devices.

One of the methods for reducing the cost, stepping up the service life and curtailing the time required for erection of smoke stacks lies in turning over to the construction of sectional prestressed reinforced-concrete stacks. However, in spite of their obvious advantages, such stacks are not yet popular.

The cause of this lies in that the tapered shape of a very tall stack is achieved with certain difficulties which consist in standardization of its elements, complexity of erection, and sealing of joints. Therefore, all the sectional smoke stacks yet built have a limited height. Comparatively small smoke stacks (up to 75 m) are being built in England by "Kirner Moodie Concrete, Ltd". Another British firm "Messrs John Ellis & Sons, Ltd" erects short multiple-shaft sectional stacks with an outside diameter reaching as little as 2.0 m. In cases calling for the erection of higher stacks, preference is given to stacks from monolithic reinforced concrete through the above-stated reasons.

The prior art device of the structure according to the present invention is the water cooling tower comprising a framework of reinforced-concrete bars oriented along the straight generating lines of the curvilinear surface of the tower, with reinforced-concrete beams located at their intersections and forming circular collars (L. I. Kleimach, e.a. "Erection of Tall Reinforced-Concrete Structures", Stroyizdat, Moscow 1962, pp. 205–206, FIG. 133).

A disadvantage of this and above-mentioned structures lies in that the rectilinear components oriented along the the generating lines and forming a curvilinear surface, e.g. a hyperboloid of revolution, extend throughout the height of the tower, from its foot to the mouth. The number of bars or uprights and, consequently, their reduced area at all the elevation marks of the structure remains constant. However, from the viewpoint of static and dynamic functioning of the tower, when the acting forces diminish from the foot to the mouth, such a constancy of the cross sectional area is impracticable and uneconomical. In a number of structure this disadvantage is eliminated by reducing gradually the cross section of the uprights. This, in turn, increases the number of type-sizes of the built-up elements and complicates the erection of the structure.

Besides, the prototype of the claimed structure is not of a prestressed instruction but of a conventional type.

An object of the present invention is to provide a sectional tower structure whose straight uprights would be made and arranged in space in such a way as to form a strong, rigid, crack-proof, durable, prestressed structure.

This object is accomplished by providing a sectional tower structure comprising a reinforced-concrete lattice framework in the form of an one-sheet hyperboloid consisting of inclined intersecting straight uprights made of individual elements and fastened together by horizontal bands which divide the structure into tiers wherein, according to the invention, the straight elements of the uprights are provided in the longitudinal direction with hollows to receive prestressed reinforcement strands anchored in the bands located at the points of maximum convergence of the adjacent uprights.

The hollows in the elements of the uprights located along the straight generating lines of the hyperboloid accommodate reinforcement strands which, when tensioned, produce a rigid three-dimensional prestressed framework which combines all the advantages of the prestressed reinforced concrete with rigidity and stability of three-dimensional systems of the one-sheet hyperboloid type.

The strand-type reinforcement is anchored in the bands so that during erection every part of the structure can be regarded as an independent load-bearing structure taking all the assembly loads.

Besides, according to the invention, the sectional structure has additional tiers located between the main adjacent tiers, said additional tiers being formed by hollow blocks where the prestressed reinforcement strands intersect each other.

The provision of additional tiers made up of hollow box-shaped elements accommodating the intersecting reinforcement strands simplifies considerably the dsign of the joints in the band zone; in particular, there is no need for making the mutually intersecting longitudinal spaces in said zone for the passage of reinforcement strands.

Besides, the uprights of the sectional structure consist, according to the invention, of elements and hollow blocks of one and the same type-size while the number of uprights diminishes gradually from tier to tier depending on the forces applied to the framework and their height alternates from the foot of the tower where they are arranged at a uniform pitch and the uprights forming each tier except the first one are a straight extension of some of the uprights of the underlying tiers.

The reduction of the number of uprights from tier to tier along the height of the structure makes it possible, while retaining the geometry of the tower, to bring the structure in conformity with the nature of the acting forces not by changing the lateral dimensions of the uprights which calls for an increase in their type-sizes, but by changing their number. This allows the elements of the tower uprights to be made practically of one type-size and renders the design more economical.

In the sectional structure according to the invention the straight elements and hollow blocks making up the uprights are of either rectangular or round section.

The rectangular or round cross section of the straight elements, i.e. a simple shape, ensures a maximum standardization and industrialization of their fabrication, as well as simple and speedy process of erectng the structure.

Now the invention will be described by way of example with reference to the accompanying drawings, in which:

FIG. 1 is a schematic general view of the tower structure according to the invention;

FIG. 2, same, top view;

The tower structure according to the invention comprises a reinforced-concrete lattice framework in the form of an one-sheet hyperboloid, comprised of intersecting inclined straight uprights 1, 2 and 3 (FIGS. 1 and 2) made from individual elements. These uprights are oriented along the generating lines of the surface of the one-sheet hyperboloid and arranged at a uniform pitch near the tower foot "A", alternating along the height of the tower.

Figure 1:
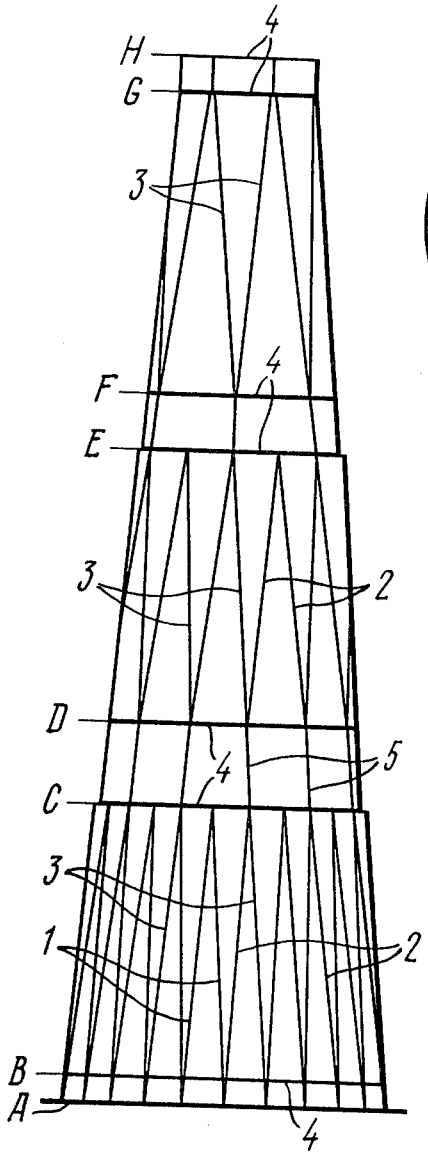
Figure 2:
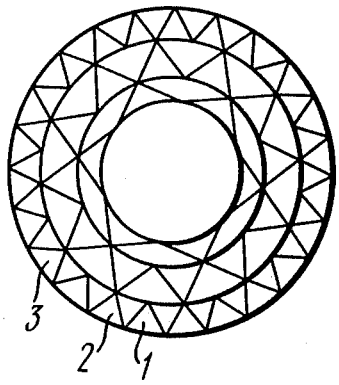
Figure 3:
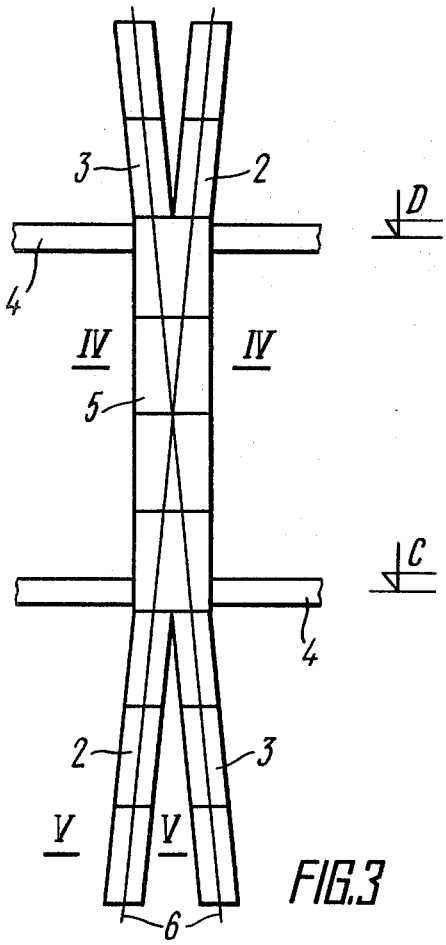
FIG. 3 shows a part of the structure near the band zone, enlarged.

At the points of maximum convergence of the uprights 1, 2 and 3 there are bands 4 (FIG. 3) dividing the tower into tiers along the height; the 1st tier is designated in FIG. 1 by zone "B-C", 2nd tier by zone "D-E" and 3rd tier, by zone "F-G".

The 2nd tier "D-E" consists of the uprights 2 and 3 which are a straight extension of the part of uprights of the 1st tier "B-C" whereas the 3rd tier "F-G" consists of the uprights 3 which are an extension of some of the uprights of the 1st and 2nd tiers. Depending on the forces acting on the framework, the number of uprights diminishes from tier to tier beginning from the foot "A" of the tower.

Figure 5:
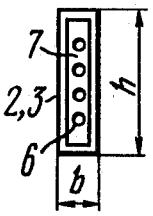
FIG. 5 is a section taken along line V—V in FIG. 3.

Provided between the adjacent main tiers are additional tiers made of box-shaped hollow blocks 5 in which the prestressed reinforcement strands 6 (FIG. 3) intersect each other. These strands are accommodated in the spaces 7 (FIG. 5) of the straight elements of the uprights 1, 2 and 3 and are anchored in the bands 4.

Figure 4:
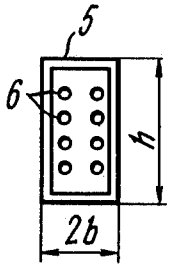
FIG. 4 is a section taken along line IV—IV in FIG. 3.

The hollow blocks 5 and the straight elements of the uprights 1, 2 and 3 are of a rectangular cross section (FIGS. 4 and 5), the width of each hollow block being twice the width of each upright. In figure the width of the upright 2 or 3 is denoted by "b" and that of the block 5-"2*b*"; "h" is the height of the hollow block and of the component elements of the uprights 1, 2 and 3.

However, the blocks 5 and uprights 1, 2 and 3 may also be of a round section (not shown in the drawing).

The surface of the claimed structure is a one-sheet hyperboloid with rectilinear generating lines along which the prestressed reinforcement is arranged. The tower is built up of precast reinforced-concrete blocks of a limited number of type-sizes. To enhance the stability of the structure, the points of maximum convergence of the generating lines are provided with reinforced-concrete stiffener collars dividing the structure into tiers.

In order to bring the structure to a maximum conformity with the nature of the acting forces, some of the uprights are interrupted in height at points of their maximum convergence while the remaining uprights extend to the mouth of the structure, thus forming a three-dimensional framework with already reduced corrected cross section which corresponds to the forces acting in the given zone. The tower structure is built up of prefabricated reinforced-concrete elements provided with hollows for accommodating the prestressed strand-type reinforcement.

The prestressed reinforcement strands intersect in the hollow box-shaped blocks whose width is twice the width of the main uprights. These box-shaped blocks form additional tiers limited by the bands. After tensioning, the reinforcement strands are anchored tier after tier in the bands while the hollows in the elements are filled with concrete mix.

The claimed sectional supporting structure features many merits as compared with the prior art ones. The three-dimensional lattice framework combines in itself all the advantages of the prestressed reinforced concrete, the rigidity and stability of the three-dimensional systems such as a one-sheet hyperboloid. Due to prestressing, the joints between the blocks are made simply, reliably and without any welding work. Accommodation of the main load-bearing reinforcement inside the elements and compression of the concrete elements which rules out cracking in service ensure corrosion resistance of reinforcement thereby promoting the durability of the structure as a whole. Besides, the use of high-strength reinforcement cuts down the consumption of concrete and steel, diminishes the weight of the stack and, correspondingly, the dimensions of its foundation.

What is claimed is:

1. A sectional tower structure comprising: a reinforced-concrete lattice framework made in the form of an one-sheet hyperboloid and constituted by intersecting inclined straight uprights consisting of individual elements; uprights of said framework oriented along the generating surface of the one-sheet hyperboloid; hollows made in the straight elements of the uprights of said framework in a longitudinal direction; horizontal bands located at the points of maximum convergence of the adjacent uprights and intended to fasten the uprights to one another; prestressed reinforcement strands located in said hollows of the uprights and anchored in said bands; said bands dividing said framework into tiers.

2. A sectional structure according to claim 1 wherein between the adjacent tiers there are additional tiers formed by hollow blocks in which the prestressed reinforcement strands intersect each other.

3. A sectional structure according to claim 2 wherein the uprights consisting of individual elements, and hollow blocks are of one and the same type-size and the number of said uprights diminishes from tier to tier to suit the forces acting on the framework and the uprights alternate in height beginning from the foot of the tower where they are arranged at a uniform pitch and wherein the uprights constituting each tier except the first one are a straight extension of a number of uprights in the underlying tiers.

4. A sectional structure according to claim 2 wherein the straight elements and hollow blocks of the uprights are of a rectangular cross section.

5. A sectional structure according to claim 2 wherein the straight elements of the uprights and the hollow blocks are of a round cross section.

* * * * *